US008113503B2

(12) United States Patent
Roth et al.

(10) Patent No.: US 8,113,503 B2
(45) Date of Patent: Feb. 14, 2012

(54) AUTOMATIC WARP COMPENSATION

(75) Inventors: Curtis A. Roth, Post Falls, ID (US); Craig Gendreau, Spokane, WA (US); Chad Faith, Liberty Lake, WA (US)

(73) Assignee: J&L Group International, LLC, Keithville, LA (US)

( * ) Notice: Subject to any disclaimer, the term of this patent is extended or adjusted under 35 U.S.C. 154(b) by 587 days.

(21) Appl. No.: 12/105,934

(22) Filed: Apr. 18, 2008

(65) Prior Publication Data

US 2009/0115122 A1 May 7, 2009

Related U.S. Application Data

(60) Provisional application No. 60/985,450, filed on Nov. 5, 2007.

(51) Int. Cl.

| | |
|---|---|
| ***B65H 1/18*** | (2006.01) |
| ***B65H 1/08*** | (2006.01) |
| ***B65G 59/06*** | (2006.01) |
| ***B65G 59/00*** | (2006.01) |

(52) U.S. Cl. ..... 271/152; 271/148; 414/796; 414/797.9

(58) Field of Classification Search ..... 271/176, 271/177, 180, 155, 148, 152, 154, 221; 414/796.6, 414/796.8, 795.4, 796.5, 796, 797.9

See application file for complete search history.

(56) References Cited

U.S. PATENT DOCUMENTS

| | | | | |
|---|---|---|---|---|
| 3,716,226 | A * | 2/1973 | Kistner | 271/31 |
| 4,940,221 | A * | 7/1990 | Wirz et al. | 271/107 |
| 5,356,131 | A * | 10/1994 | Mauro | 271/288 |
| 5,924,839 | A * | 7/1999 | Dopke et al. | 414/796 |
| 6,585,256 | B2 * | 7/2003 | Blackwell et al. | 271/150 |
| 2001/0042954 | A1 * | 11/2001 | Rebeaud | 271/154 |
| 2005/0110207 | A1 * | 5/2005 | Moore et al. | 271/152 |
| 2005/0281644 | A1 * | 12/2005 | Lussen et al. | 414/403 |
| 2007/0102870 | A1 * | 5/2007 | Moore et al. | 271/152 |

FOREIGN PATENT DOCUMENTS

JP 07109043 A 4/1995

* cited by examiner

*Primary Examiner* — Kaitlin Joerger
*Assistant Examiner* — Patrick Cicchino
(74) *Attorney, Agent, or Firm* — Dorsey & Whitney LLP; Kenneth L. Levitt, Esq.

(57) ABSTRACT

The present disclosure includes an apparatus for feeding a stack of sheet stock in blocks. The apparatus includes a backstop, a block pusher plate, and at least one sensor for determining a height differential between the stack at generally near a lead edge of the stack and the stack at generally near a trail edge of the stack. The apparatus automatically adjusts for warp in the sheet stock. The present disclosure further includes a method comprising obtaining a first measurement at generally near a lead edge side of the stack, obtaining a second measurement at generally near a trail edge side of the stack, comparing the first and second measurements, and pushing the portion of sheet stock from the stack with a block pusher plate when the second measurement is within a predetermined tolerance of the first measurement.

19 Claims, 7 Drawing Sheets

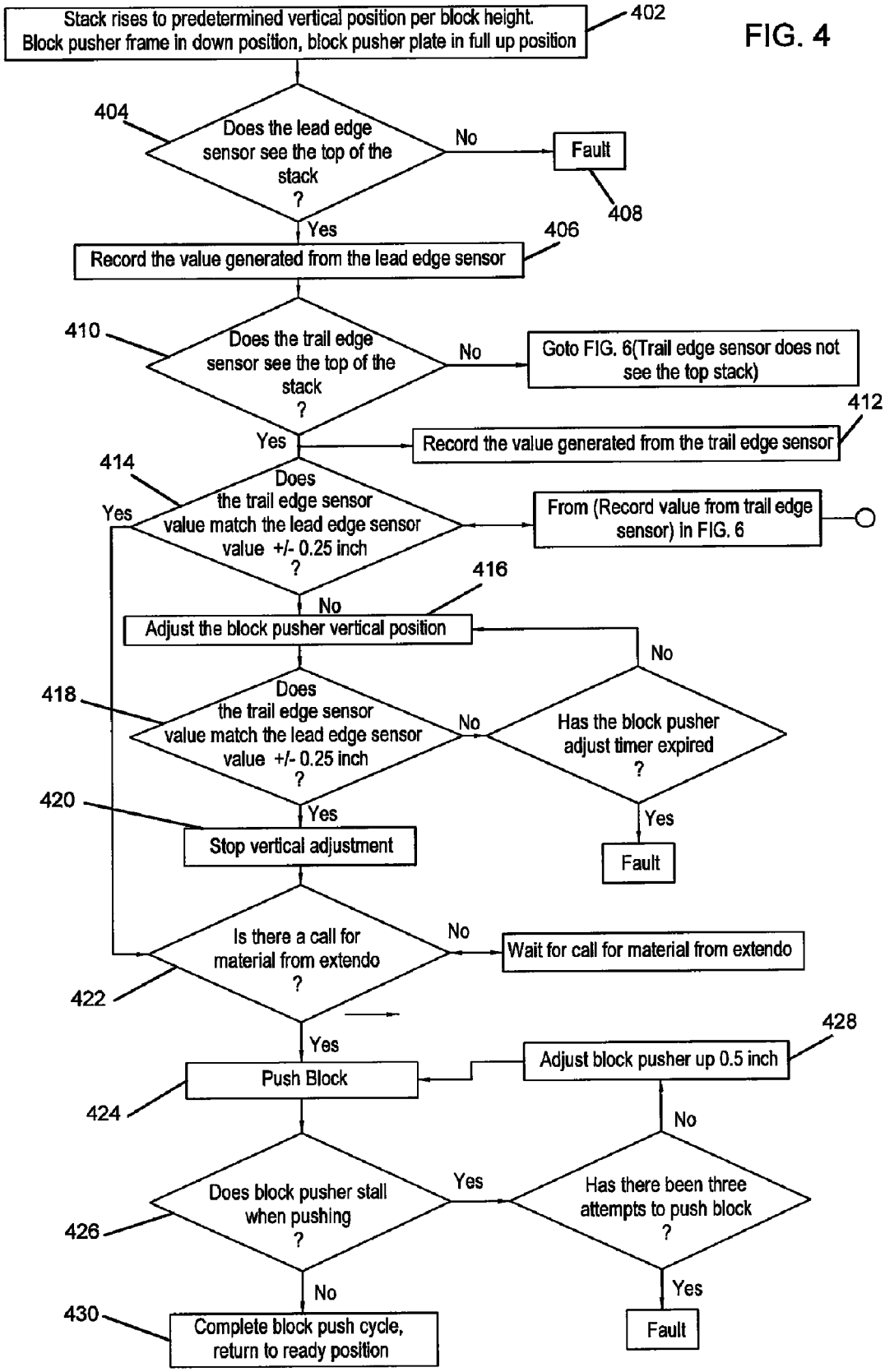
Stack rises to predetermined vertical position per block height. Block pusher frame in down position, block pusher plate in full up position
402
FIG. 4
404
Does the lead edge sensor see the top of the stack ?
No
Fault
408
Yes
406
Record the value generated from the lead edge sensor
410
Does the trail edge sensor see the top of the stack ?
No
Goto FIG. 6(Trail edge sensor does not see the top stack)
412
Yes
Record the value generated from the trail edge sensor
414
Does the trail edge sensor value match the lead edge sensor value +/- 0.25 inch ?
Yes
From (Record value from trail edge sensor) in FIG. 6
416
No
Adjust the block pusher vertical position
No
418
Does the trail edge sensor value match the lead edge sensor value +/- 0.25 inch ?
No
Has the block pusher adjust timer expired ?
Yes
Fault
420
Yes
Stop vertical adjustment
Is there a call for material from extendo ?
No
Wait for call for material from extendo
422
Yes
428
Adjust block pusher up 0.5 inch
Push Block
424
No
Does block pusher stall when pushing ?
Yes
Has there been three attempts to push block ?
426
No
Yes
430
Complete block push cycle, return to ready position
Fault

AUTOMATIC WARP COMPENSATION

CROSS-REFERENCE TO RELATED APPLICATIONS

This application claims benefit of U.S. Ser. No. 60/985,450 filed Nov. 5, 2007, the contents of which are incorporated herein by reference.

FIELD OF THE INVENTION

The present disclosure relates to apparatus and methods for prefeeders with automatic warp compensation. More particularly, the present disclosure relates to apparatus and methods for block pusher prefeeders with automatic warped board compensation.

BACKGROUND OF THE INVENTION

A prefeeder may be designed to handle blank sheets. The blank sheets are typically corrugated material. The prefeeder receives a stack of blank sheets, divides the stack into blocks, and feeds the blocks into a finishing machine in an intermittent shingled stream. Particularly, a block pusher prefeeder may receive the stack of blank sheets, lift the stack up, divide the stack into measured blocks, and then feed the sheets off the bottom of the block under a vertical stop in a continuous shingled stream for delivery into the finishing machine hopper.

With current block pusher technology, a stack of flat sheet stock enters the block pusher prefeeder. The lead edge of the stack is registered against a vertical stop, such as a backstop. The block pusher plate resides behind and to the top of the stack. When there is a call for another block of sheets, the stack rises, such that the stack is between the backstop and the block pusher plate. The block pusher plate then moves forward to push off a block of sheets from the top of the stack. In the standard configuration, the bottom of the block pusher plate is aligned with the top of the backstop, so as to produce a horizontal plane. This horizontal plane defines the separation point in the stack, wherein the sheet above the plane is the bottom sheet of the block and the sheet below the plane is the top sheet of the stack.

When there is down warp, the leading edge of the stack is lower than the trail edge of the stack. As a result, when the block pusher plate moves forward to deliver a block of sheets, the block pusher plate stalls due to the sheets that are captured/jammed between the block pusher plate and the backstop. When there is up warp, the leading edge of the stack is higher than the trail edge of the stack. When the block pusher plate moves forward to deliver a block of sheets, trailing sheets (i.e., sheets that are not aligned with the block or the stack) result.

Current block pusher prefeeders allow the operator to select a warp mode which lifts the block pusher plate. Elevating the bottom of the block pusher plate relative to the backstop allows the block pusher plate to convey forward and push a down warped block of sheets successfully off the stack.

Warp mode cannot be enabled permanently due to the potential for a trailing sheet condition when running flat, or non-warped, sheets. When the bottom of the block pusher plate and the top of the backstop are not correctly aligned in elevation (i.e., the bottom of the block pusher plate is above the top of the backstop), a scenario arises when running flat sheets where the bottom sheet(s) of the block, or the top sheet(s) of the stack, begin to move, but then stall and are no longer aligned with the block or the stack. This may causes issues with the manufacturing line efficiency.

With the selector switch for warp mode at the operator station, the operator is required to make the decision regarding when to use the warp mode and when to disable warp mode. Upon visual inspection of a stack, the operator can select a mode to allow the prefeeder to handle warp or select a mode where the prefeeder handles no warp. Use of a selector switch results in an increased risk for human error. For example, the operator may enable warp mode at times when warp mode is undesirable, thereby causing trailing sheets to occur. Similarly, the operator may disable warp mode at times when warp mode is desirable. Thus, the block pusher plate may stall against the back of the stack due to down warp. As an additional example, the operator may enable warp mode where warp mode is desirable (i.e., the stack contains warped sheets). However, the sheets at the bottom of the stack may be pressed flat due to the weight of the stack. That is, the amount of warp may diminish from the top of the stack to the bottom of the stack, and therefore, with warp mode enabled, trailing sheets may be present in the last few block pushes of the stack. Thus, to have an efficient operation, the operator must always be cognizant of whether warp is present in the stack and select the appropriate mode.

Thus, there is a need in the art for apparatus and methods for prefeeders with automatic warp compensation. There is a further need in the art for apparatus and methods for block pusher prefeeders with automatic warped board compensation.

BRIEF SUMMARY OF THE INVENTION

The present invention, in one embodiment, is an apparatus for feeding a stack of sheet stock to a finishing machine in blocks comprising a portion of the stack, wherein the apparatus automatically adjusts for warp in the sheet stock. The apparatus includes a backstop positioned generally near a lead edge of the stack, a block pusher plate positioned generally near a trail edge of the stack, and at least one sensor for determining a height differential between the stack at generally near a lead edge of the stack and the stack at generally near a trail edge of the stack. In one embodiment, the apparatus includes a lead edge sensor generally near the lead edge of the stack, and a trail edge sensor generally near the trailing edge of the stack.

The present invention, in another embodiment, is a method for pushing a portion of sheet stock from a stack of sheet stock. The method includes automatically compensating for warp present in the sheet stock. The method comprises obtaining a first measurement at generally near a lead edge side of the stack, obtaining a second measurement at generally near a trail edge side of the stack, comparing the first and second measurements, and pushing the portion of sheet stock from the stack with a block pusher plate when the second measurement is within a predetermined tolerance of the first measurement and, in some embodiments, an additional offset value. In one embodiment, obtaining a first measurement may include providing a first sensor for determining a distance from a known point above a lead edge side of the stack to the top of the lead edge side of the stack, and obtaining a second measurement may include providing a second sensor for determining a distance from a known point above a trail edge side of the stack to the top of the trail edge side of the stack.

The present invention, in yet another embodiment, is a method for feeding a stack of sheet stock to a finishing machine in blocks comprising a portion of the stack. The method automatically adjusts for warp in the sheet stock. The method includes determining a height differential between a lead edge side of the stack and a trail edge side of the stack and feeding a block of sheet stock from the stack based on the height differential. In one embodiment, a laser scanner is used for determining the height differential. In another embodiment, determining the height differential comprises determining the slope of the stack.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the drawings and detailed description are to be regarded as illustrative in nature and not restrictive.

BRIEF DESCRIPTION OF THE DRAWINGS

While the specification concludes with claims particularly pointing out and distinctly claiming the subject matter that is regarded as forming the present invention, it is believed that the invention will be better understood from the following description taken in conjunction with the accompanying Figures, in which:

FIG. 4 is a flow diagram of a process of automatic warp compensation in accordance with another embodiment of the present disclosure.

DETAILED DESCRIPTION

The present disclosure includes novel and advantageous apparatus and methods for prefeeders with automatic warp compensation. More particularly, the present disclosure relates to apparatus and methods for block pusher prefeeders with automatic warped board compensation. The applications of such devices may be exemplified in prefeeders for stacks of corrugated material, drywall, paper board, and other types of generally flat sheets of material where warp may be present.

Automatic warp compensation (AWC) of the present disclosure may take the operator out of the decision process. AWC may enable the prefeeder to adjust for warp in real time for each block push. Generally, AWC may evaluate the stack height at lead and trail edges of the stack and adjust the block pusher height to compensate for warp. Each block push may require a separate evaluation and potential block pusher height adjustment.

AWC may be used with any suitable block pusher prefeeder, such as bottom feeders, top feeders, and universal feeders. The apparatus and methods disclosed herein may be adapted for use with all such suitable block pusher prefeeders. Therefore, the illustrations of AWC in the figures, which may generally show AWC in combination with a block pusher bottom feeder, are exemplary and not limiting.

More specifically, AWC may use one or more sensors to capture measurements from a known point or height to the top of the stack at the lead edge and the trailing edge. The measurements from the one or more sensors may be compared and evaluated for stack height differential from the lead edge to the trail edge of the stack. The measurements may be used to determine if any warp in the sheets of the stack is present. If warp is present, the measurements may be used to determine how much. The measurements may further be used to determine where the block pusher plate could be adjusted vertically for correct warp compensation. After each block push, the stack may be reevaluated allowing the prefeeder to compensate for varying warp as the stack is processed.

Figure 1:
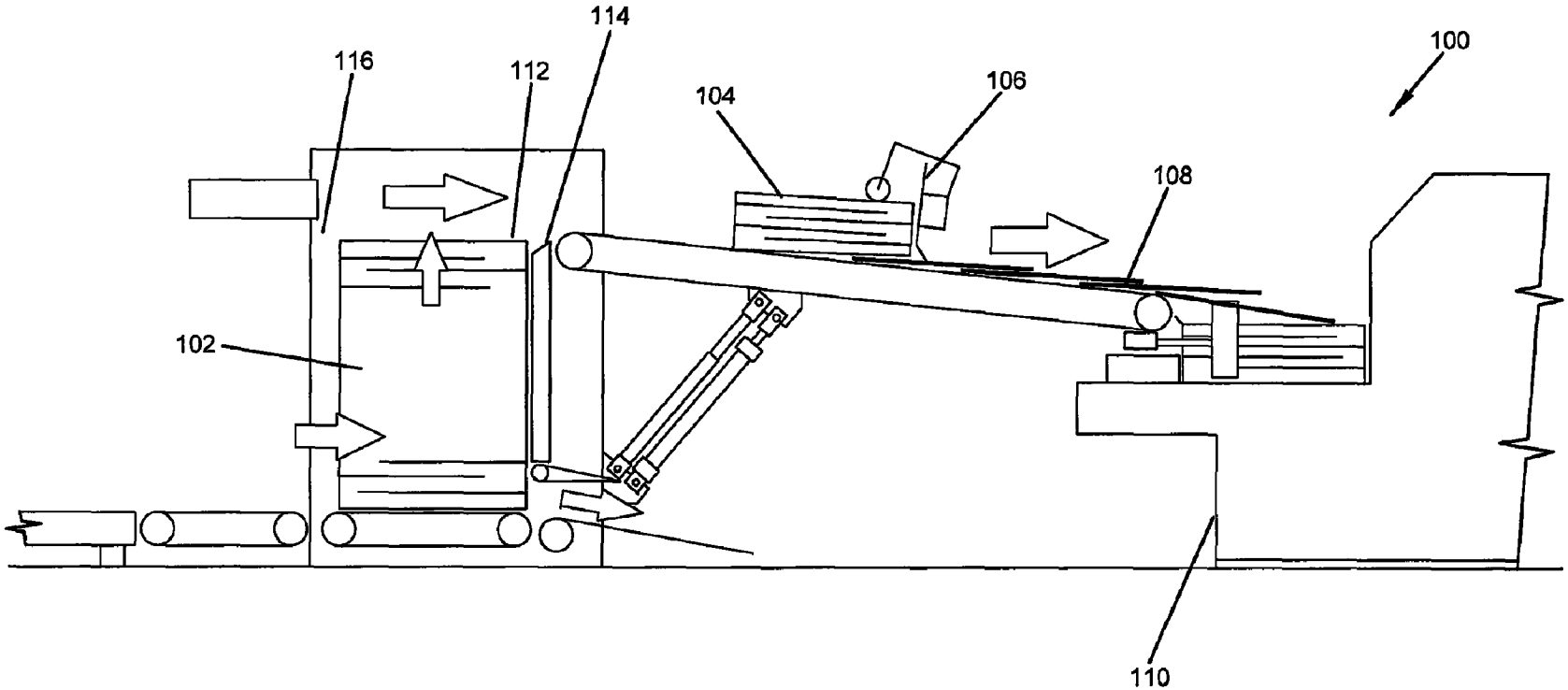
FIG. 1 is an elevation view of a prior art block pusher prefeeder.

As previously stated, a prefeeder receives a stack of sheet stock, divides the stack into blocks, and feeds the blocks into a finishing machine in a shingled stream. A block pusher prefeeder 100, as illustrated in one embodiment in FIG. 1, may receive a stack of sheet stock 102, lift the stack up, divide the stack into measured blocks 104, and then feed the sheets off the bottom of the block under a vertical stop 106 in a continuous shingled stream 108 for delivery into a finishing machine hopper 110. Particularly, a stack of flat sheet stock 102 enters the block pusher bottom feeder 100. The lead edge 112 of the stack may be registered against a vertical stop, such as a backstop 114. A block pusher plate 116 may reside behind and to the top of the stack 102. When there is a call for another block of sheets 104, the stack 102 may be raised, such that the stack 102 is between the backstop 114 and the block pusher plate 116. The block pusher plate 116 may then move forward to push off a block of sheets 104 from the top of the stack 102. As used herein, the terms "sheet stock" or "sheet (s)" may include corrugated material, drywall, paper board, and other types of generally flat sheets of material.

Figure 2A:
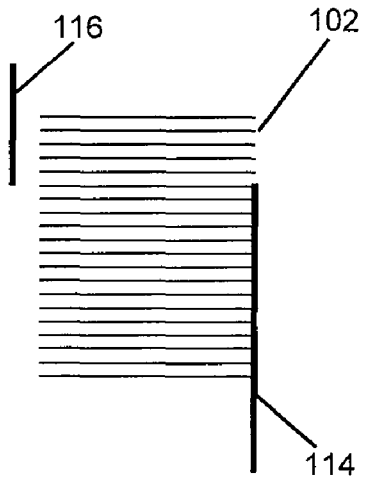
FIG. 2A is an elevation view of a flat stack of sheet stock between a block pusher plate and a backstop of a prior art block pusher prefeeder.
Figure 2B:
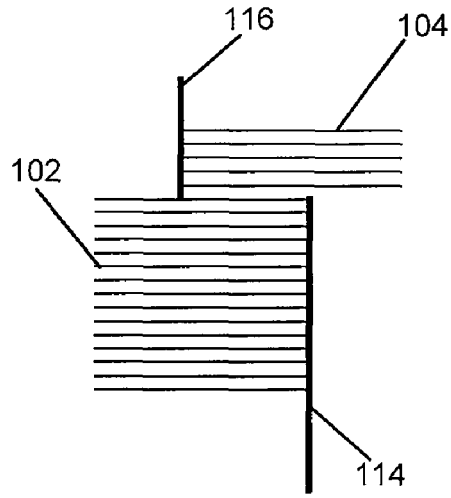
FIG. 2B is an elevation view of the flat stack of sheet stock between the block pusher plate and backstop of FIG. 2A, wherein the block pusher plate is pushing a block of sheets from the stack.
Figure 2C:
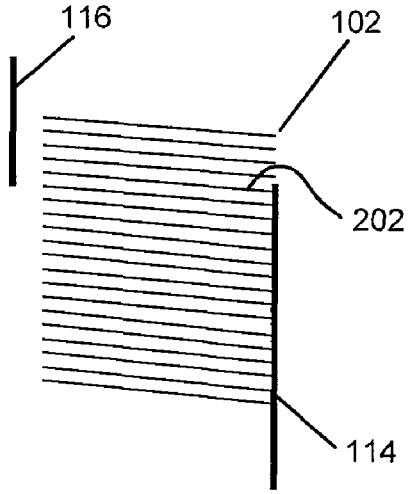
FIG. 2C is an elevation view of a stack of down warped sheet stock between a block pusher plate and a backstop of a prior art block pusher prefeeder.
Figure 2D:
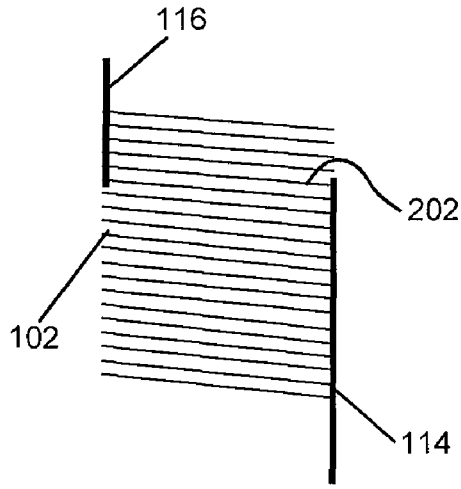
FIG. 2D is an elevation view of the stack of down warped sheet stock between the block pusher plate and backstop of FIG. 2D, wherein the block pusher plate is jammed while attempting to push a block of sheets from the stack.

In an ideal situation, wherein the sheet stock is completely flat (i.e., no warp present), as illustrated FIGS. 2A and B, a block of sheets 104 may be pushed from the stack 102 by the block pusher 116 by generally aligning the bottom of the block pusher 116 with the top of the backstop 114. However, sheet stock is not always flat and may have warp. When down warp, i.e., the leading edge of the stack is lower than the trail edge of the stack, is present, as illustrated in FIGS. 2C and D, one or more sheets 202 at the bottom of the block may become captured/jammed between the block pusher plate 116 and the backstop 114, thereby stalling the block pusher plate 116.

Figure 2E:
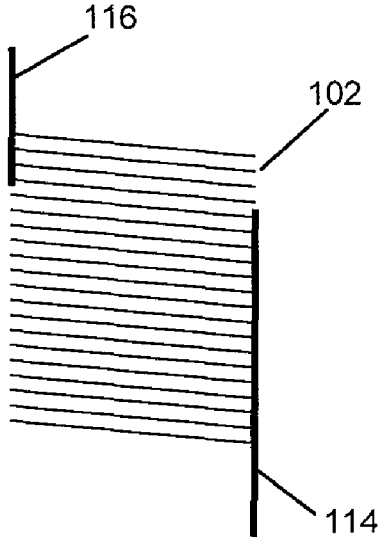
FIG. 2E is an elevation view of a stack of down warped sheet stock between a block pusher plate and a backstop of a prior art block pusher prefeeder in warp mode.
Figure 2F:
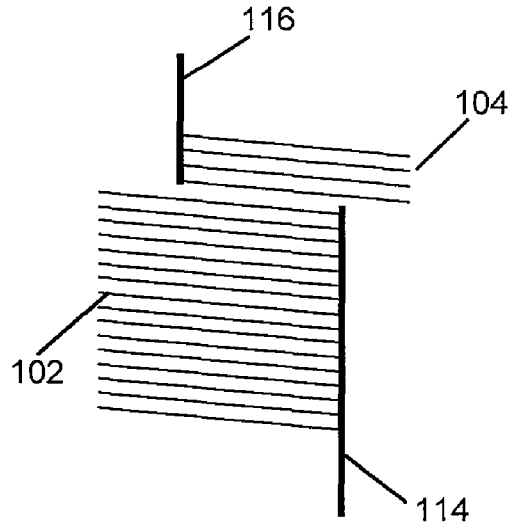
FIG. 2F is an elevation view of the stack of down warped sheet stock between the block pusher plate and backstop of FIG. 2E, wherein the block pusher plate is pushing a block of sheets from the stack.
Figure 2G:
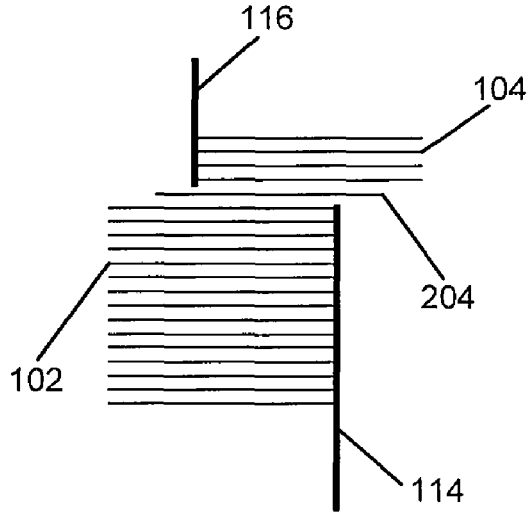
FIG. 2G is an elevation view of a flat stack of sheet stock between a block pusher plate and backstop of a prior art block pusher prefeeder in warp mode, wherein a trailing sheet results when the block pusher plate attempts a push.

In a further embodiment, when down warp is present, the block plate pusher 116 may be raised vertically, such that the bottom of the block plate pusher 116 is above, and not aligned with, the top of the backstop 114, as illustrated in FIG. 2E. Therefore, when the block pusher plate 116 pushes a block of sheets 104 from the stack 102, as illustrated in FIG. 2F, the block pusher plate 116 does not stall on jammed sheets 202. However, it may be undesirable to maintain the block pusher plate 116 at an increased height above the backstop 114 when warp is not present. For example, as illustrated in FIG. 2G, if the bottom of the block pusher plate 116 is not aligned with the top of the backstop 114 when no warp is present, one or more trailing sheets 204 may result.

Figure 3:
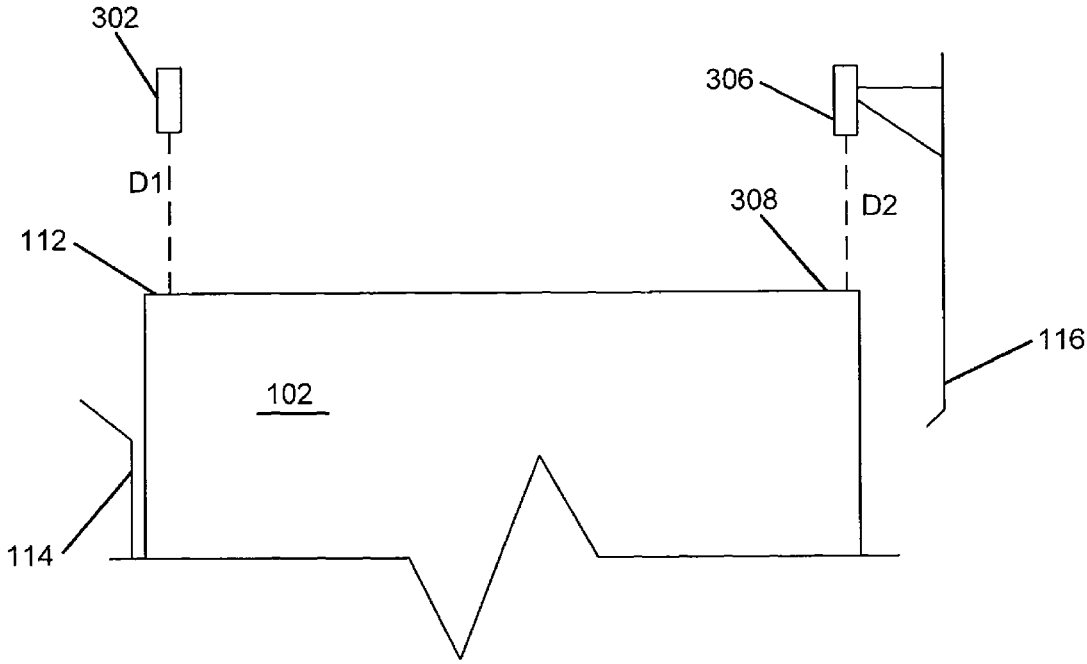
FIG. 3 is an elevation view of a stack of sheet stock between a block pusher plate and a backstop of a block pusher prefeeder in accordance with one embodiment of the present disclosure, wherein a sensor is positioned above the lead edge of the stack and a sensor is positioned above the trail edge of the stack.

In one embodiment, one or more sensors may be used to evaluate the amount of warp present in the stack 102 at any given point in time. With reference to FIG. 3, a first sensor 302 may be positioned above the lead edge 112 of the stack 102. The lead edge sensor 302 may be an optical sensor, ultrasonic sensor, etc. However, any sensor suitable for measuring distance may be used. The lead edge sensor 302 may be used to determine the distance D1 between the lead edge sensor 302 and the lead edge 112 of the stack 102. The lead edge sensor 302 may be operably attached to any suitable object in relation to the block pusher prefeeder 100, including operably attached to the block pusher prefeeder 100 frame. In one embodiment, the lead edge sensor 302 may be stationary in relation to the block pusher prefeeder 100.

A second sensor 306 may be positioned above a trail edge 308 of the stack 102. The trail edge sensor 306 may be an optical sensor, ultrasonic sensor, etc. However, any sensor suitable for measuring distance may be used. The trail edge sensor 306 may be used to determine the distance D2 between the trail edge sensor 306 and the trail edge 308 of the stack 102. The trail edge sensor 306 may be operably attached to any suitable object in relation to the block pusher prefeeder 100. In one embodiment, the trail edge sensor 306 may be stationary in relation to the block pusher prefeeder 100 while in other embodiments, the trail edge sensor 306 may move in relation to the block pusher prefeeder 100. In further embodiments, the trail edge sensor 306 may be operably attached to the block pusher plate 116. In one embodiment, the trail edge sensor 306 may be attached to the block pusher plate 116 frame. Thus, the trail edge sensor 306 may move with the block pusher plate 116.

In one embodiment, when the distance D1 is approximately equal to the distance D2 within a desired tolerance, the block pusher plate 116 may be in position such that the block pusher plate 116 is ready for pushing a block 104 from the stack 102. In relation to a stack of flat sheet stock, this may create a substantially horizontal plane extending from the top, or near the top, of the backstop 114 to the bottom of the block pusher plate 116. In relation to a stack of warped sheet stock, this may create a generally non-horizontal plane extending from the top, or near top, of the backstop 114 to the bottom of the block pusher plate 116. Therefore, AWC may adjust automatically and correctly for each block push of the stack 102, depending on whether warp is present in the current block 104 at the top of the stack 102.

During the process of pushing blocks from a stack, in accordance with one embodiment of the present disclosure, there may be generally three main steps. First, the distance from the lead edge sensor 302 to the top of the stack 102 at the lead edge 112 may be monitored. Then, the block pusher plate 116 may be adjusted vertically until the distance from the trail edge sensor 306 to the top of the stack 102 at the trail edge 308 is approximately within a desired range with respect to the distance from the lead edge sensor 302 to the top of the stack 102 at the lead edge 112. Upon reading that the distance has converged to the appropriate range, the block pusher plate 116 height may be set, and the block pusher plate 116 may push the block 104 from the stack 102.

Although AWC has so far been described as including a lead edge sensor 302 and a trail edge sensor 306, the use of a lead edge sensor 302 and trail edge sensor 306 is only one exemplary apparatus and method for AWC. In other embodiments, AWC may use a greater or fewer number of sensors to obtain a measurement at the lead edge 112 of the stack and a measurement at the trail edge 308 of the stack. For example, in one embodiment, a single sensor may be used to take a measurement at the lead edge 112 and trail edge 308 of the stack. The sensor may be an optical sensor, ultrasonic sensor, etc. In further embodiments, any of the sensors described herein may be laser sensors, or laser scanners.

In further embodiments yet, the measurement obtained from the one or more sensors may be the height differential between the lead edge 112 and the trail edge 308 of the stack. In some embodiments, the measurement or measurements taken may not directly be the height differential between the lead edge 112 and the trail edge 308 of the stack, but may be used to mathematically calculate the height differential. Mathematically calculating may include, but is not limited to, manually calculating or using a processor, microprocessor, CPU, controller, etc. to mathematically calculate. For example, in one embodiment, a laser scanner, or other surface or horizontal scanner, may be used to obtain or determine the height differential between the lead edge 112 and the trail edge 308 of the stack.

In alternative embodiments, a mechanical device may be used to determine the height differential between the lead edge 112 and trail edge 308 of the stack. For example, in one embodiment, a mechanical device may be used to determine the slope of the stack. Using the length of the sheets in the stack, the height differential between the lead edge 112 and the trail edge 308 of the stack may be determined using the obtained slope.

In yet other embodiments, a topographical image of the stack may be obtained and used to determine the height differential between the lead edge 112 and the trail edge 308 of the stack. Any other suitable device or method for obtaining the difference of the height of the lead edge 112 of the stack and the height of the trail edge 308 of the stack may be used in accordance with the apparatus and methods of the present disclosure.

One embodiment of a process of performing AWC in accordance with the present disclosure will now be described with further detail. It is recognized that the process described herein is exemplary and is not the sole process by which AWC, in accordance with the present disclosure and falling within the scope of this specification, may be performed. Similarly, not all steps of the disclosed process need be necessarily included, and certain steps of the process may be eliminated without departing from the spirit and scope of the present disclosure.

Figure 5A:
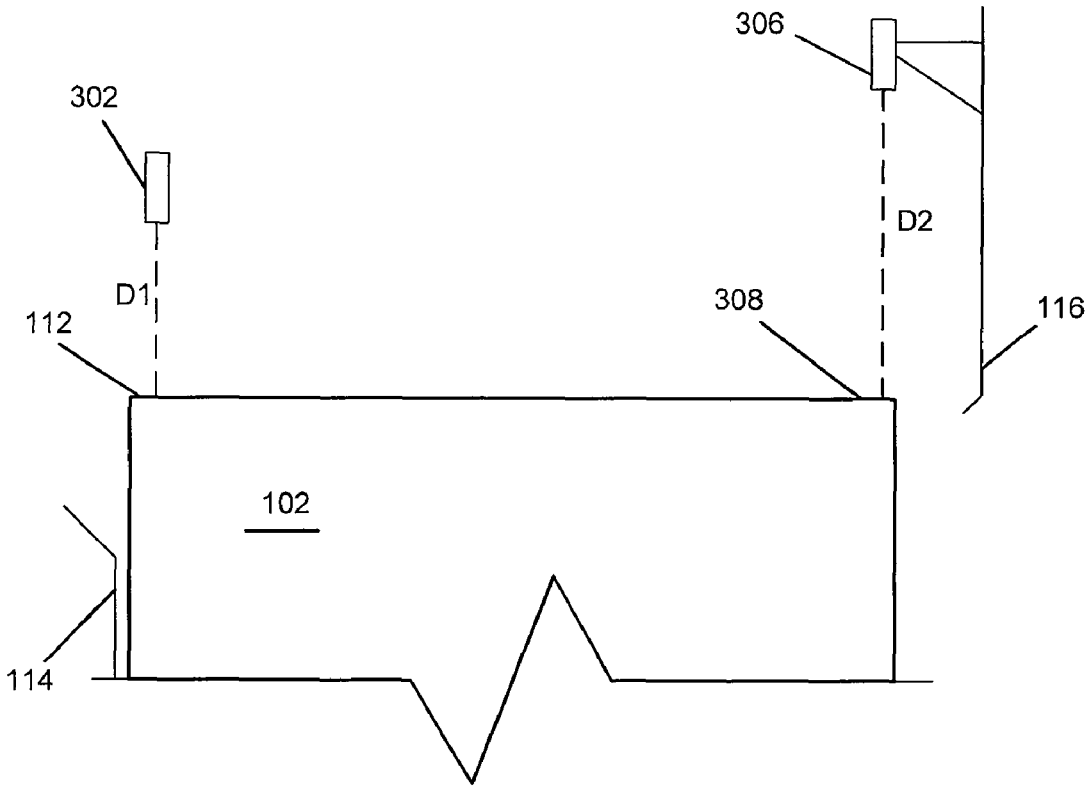
FIG. 5A is an elevation view of a stack of sheet stock between a block pusher plate and a backstop of a block pusher prefeeder in accordance with a further embodiment of the present disclosure, wherein the block pusher plate is in an "up" position.

With respect to the flow diagram shown in FIG. 4, at the beginning of a cycle (step 402), the stack 102 may be raised to a predetermined vertical position by the block pusher prefeeder 100 depending on the size of blocks 104 desired. The block pusher plate 116, and thus the trail edge sensor 306, may be in an "up" position, e.g., a position wherein the trail edge sensor 306 is higher than the lead edge sensor 302 and/or away from the stack 102, as illustrated in FIG. 5A. If the lead edge sensor 302 can sense the top of the lead edge 112 of the stack 102 (step 404), then the value of the distance from the lead edge sensor 302 to the top of the lead edge 112 of the stack 102 may be recorded (step 406). If the lead edge sensor 302 cannot sense the top of the stack 102, or can otherwise not determine the distance to the stop of the stack, a fault/error may be triggered (step 408).

Figure 6:
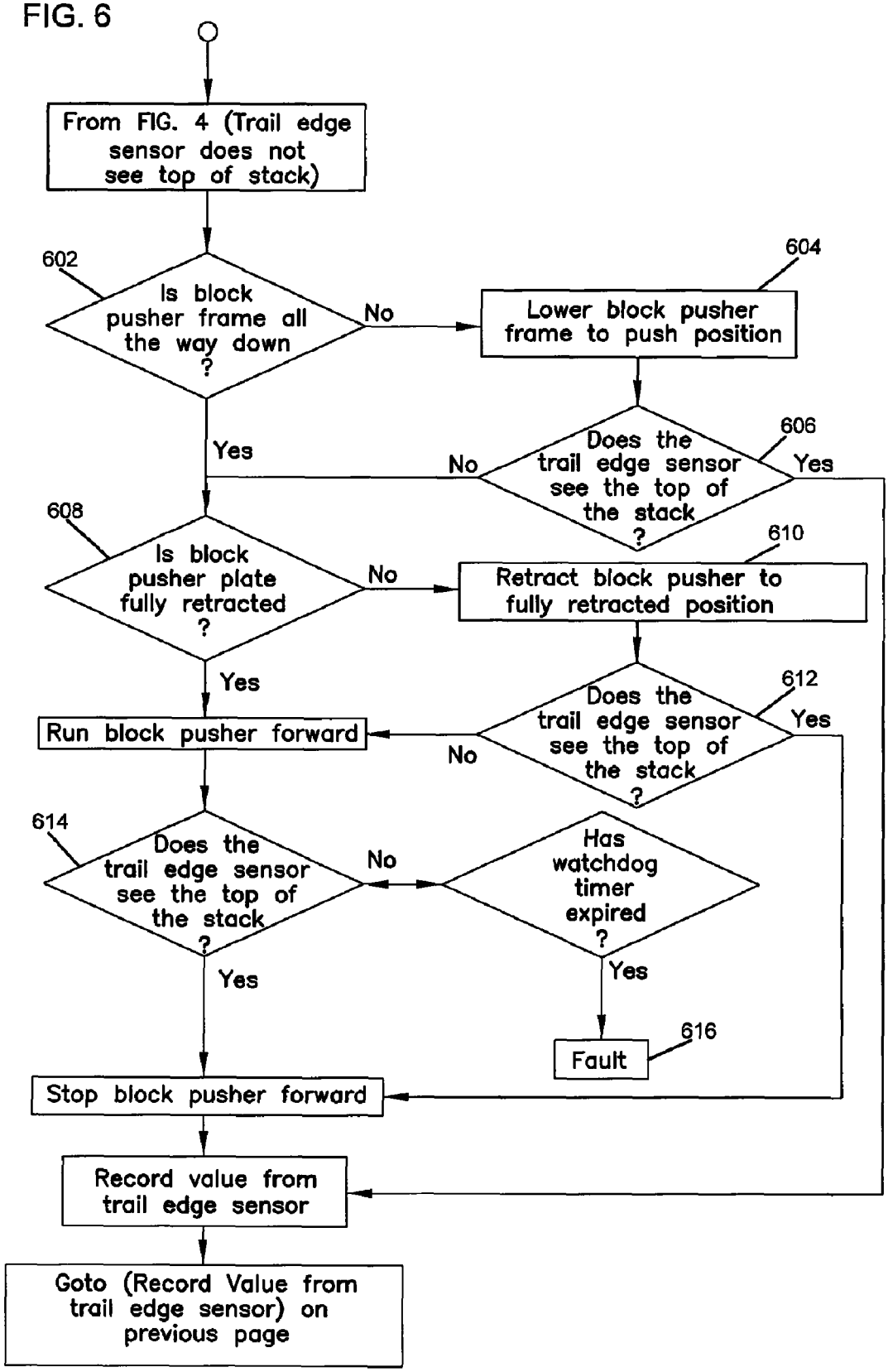
FIG. 6 is a flow diagram of a portion of a process of automatic warp compensation relating to positioning the block pusher plate in a position wherein the trail edge sensor can determine the distance to the trail edge of the stack.

If the trail edge sensor 306 can sense the top of the trail edge 308 of the stack 102 (step 410), then the value of the distance from the trail edge sensor 306 to the top of the trail edge 308 of the stack 102 may be recorded (step 412). With reference now to FIG. 6, if the trail edge sensor 306 cannot sense the top of the stack 102 and if the block pusher plate 116 frame is not all the way down in a "push" position (step 602), then the block pusher plate 116 frame may be lowered into the push position (step 604). If the trail edge sensor 306 can now sense the top of the trail edge 308 of the stack 102 (step 606), then the value of the distance from the trail edge sensor 306 to the top of the trail edge 308 of the stack 102 may now be recorded. If the trail edge sensor 302 can still not sense the top of the stack 102, then if the block pusher plate 116 is not fully retracted (step 608), the block pusher plate 116 may be retracted to a fully retracted position (step 610). If the trail edge sensor 306 can now sense the top of the trail edge 308 of the stack 102 (step 612), then the value of the distance from the trail edge sensor 306 to the top of the trail edge 308 of the stack 102 may now be recorded. If the trail edge sensor 306 can still not sense the top of the stack 102, then the block pusher plate 116 may be moved towards the stack 102 until the trail edge sensor 306 senses the top of the stack 102 (step 614). The value of the distance from the trail edge sensor 306 to the top of the trail edge 308 of the stack 102 may then be recorded. If the trail edge sensor 306 can still not sense the stop of the stack 102, then a fault may be triggered (step 616).

Figure 5B:
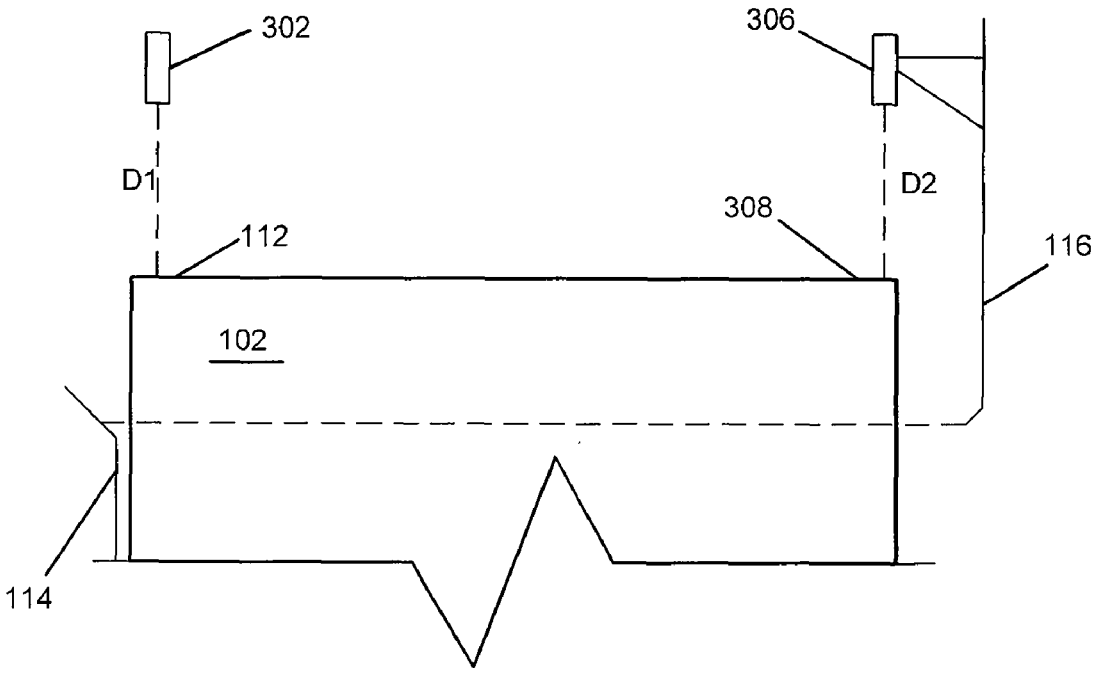
FIG. 5B is an elevation view of a stack of sheet stock between a block pusher plate and a backstop of a block pusher prefeeder in accordance with a further embodiment of the present disclosure, wherein the block pusher plate is in a "ready" position.

After the value of the distance between the lead edge sensor 302 and the lead edge 112 of the stack 102 and the value of the distance between the trail edge sensor 306 and the trail edge 308 of the stack 102 have been determined, the values may be compared. In one embodiment, if the value from the trail edge sensor 306 does not approximately match the value from the lead edge sensor 302 (step 414) to a desired tolerance, the block pusher plate may be adjusted vertically (step 416). In some embodiments, the block pusher plate may be adjusted if the values from the sensors 302 and 306 are not within about +/−0.25 inch. In other embodiments, the block pusher plate may be adjusted if the value from the sensors 302 and 306 are not within any desired tolerance range, including but not limited to, within about +/−0.5 inch, 0.75 inch, 1 inch, 1.5 inches, or any other suitable tolerance depending on the thickness of the sheets in the stack 102 and/or the desired specifications of the user. As the block pusher plate 116 is adjusted vertically to the correct position, the trail edge sensor 306 may provide continuous feedback relating to the distance between the trail edge sensor 306 and the trail edge 308 of the stack 102. When the distance measured at the trail edge 308 approximately matches the distance measured by the lead edge sensor 302 at the lead edge 112 of the stack 102 to within the desired tolerance, the block pusher plate 116 may stop traveling vertically and may be ready to push the block 104 from the stack 102 (steps 418 and 420). The ready position, for one embodiment of AWC in accordance with the present disclosure, is illustrated in FIG. 5B, wherein distance D2 approximately matches D1. In alternative embodiments, it may be desirable that the lead edge sensor 302 and trail edge sensor 306 are aligned such that the ready position occurs at a point when distance D2 does not approximately match distance D1. For example, in one embodiment, it may be desirable that at a ready position, D2 may be at some desirable offset value or distance from D1. As used herein, an offset value or distance may include any suitable nonzero offset as well as a zero or substantially zero offset. As such, if the offset is zero or substantially zero, as previously described, distance D2 may approximately match distance D1 at the ready position.

In yet further embodiments, the trail edge sensor 306 may be used to determine the distance from the trail edge sensor 306 to the top of the trail edge 308 of the stack 102. The block pusher plate 116 may be adjusted vertically to the correct position using a separate sensor, such as a potentiometer, encoder, laser, or any other suitable sensor. The separate sensor may be operably attached to any suitable object in relation to the block pusher prefeeder 100. In one embodiment, the separate sensor may be stationary in relation to the block pusher prefeeder 100 while in other embodiments, the separate sensor may move in relation to the block pusher prefeeder 100. In further embodiments, the separate sensor may be operably attached to the block pusher plate 116. In one embodiment, the separate sensor may be attached to the block pusher plate 116 frame. Thus, the separate sensor may move with the block pusher plate 116.

Once a block 104 has been called for (step 422), the block pusher plate 116 may push the block 104 from the stack 102 (step 424). If the block pusher plate 116 stalls (step 426), the block pusher plate 116 may be adjusted vertically (step 428) and may attempt another push on the block 104. After a block 104 has been pushed from the stack 102, the cycle may be completed and the block pusher plate 116 may be returned to a ready position (step 430).

Although the present invention has been described with reference to preferred embodiments, persons skilled in the art will recognize that changes may be made in form and detail without departing from the spirit and scope of the invention. For example, as previously described, the use of a lead edge sensor and a trail edge sensor is exemplary and not limiting. Any suitable number of sensors or other suitable device or method for obtaining the difference of the height of the lead edge 112 of the stack and the height of the trail edge 308 of the stack may be used in accordance with the apparatus and methods of the present disclosure.

We claim:

1. A method for pushing a block of a plurality of sheets from a stack of sheet stock and automatically compensating for warp present in the sheet stock, the method comprising:

obtaining a first measurement at generally near a lead edge side of the stack;

obtaining a plurality of second measurements of a distance from a block pusher plate to generally near a trail edge side of the stack while adjusting the block pusher plate in the direction of stack height of the stack of sheet stock; and pushing the block of a plurality of sheets from the stack with the block pusher plate when a comparison of the first measurement and a given one of the plurality of second measurements results in the given one of the plurality of second measurements being within a predetermined tolerance of the first measurement plus an offset value.

2. The method of claim 1, wherein the offset value is substantially zero.

3. The method of claim 1, wherein obtaining a first measurement at generally a lead edge side of the stack comprises providing a first sensor for determining a distance from a known point above a lead edge side of the stack to the lead edge side of the stack, the known point above the lead edge side of the stack being the position of the first sensor, and wherein obtaining a plurality of second measurements of a distance from a block pusher plate to generally near a trail edge side of the stack comprises providing a second sensor for determining a distance from a known point on the block pusher plate above a trail edge side of the stack to the trail edge side of the stack.

4. The method of claim 3, wherein the second sensor is physically coupled to the block pusher plate and moves therewith relative to the stack.

5. The method of claim 3, wherein the first and second sensors are optical sensors.

6. The method of claim 3, wherein the first and second sensors are ultrasonic sensors.

7. The method of claim 4, wherein the predetermined tolerance is .+–.0.25 inch.

8. The method of claim 4, wherein the sheet stock is corrugated material.

9. The method of claim 4, wherein the sheet stock is paper board.

10. The method of claim 4, wherein a portion of the stack of sheet stock is warped.

11. The method of claim 10, wherein a portion of the stack of sheet stock is not warped.

12. A method for feeding a stack of sheet stock to a finishing machine in blocks comprising a portion of the stack, wherein the method automatically adjusts for warp in the sheet stock, the method comprising:

determining a height differential between a lead edge side of the stack and a trail edge side of the stack;

adjusting a block pusher plate generally vertically based on the height differential, in order to compensate for the height differential; and feeding a block of sheet stock from the stack using the adjusted vertical position of the block pusher plate.

13. The method of claim 12, wherein one or more optical sensors are used for determining the height differential.

14. The method of claim 12, wherein one or more laser scanners are used for determining the height differential.

15. The method of claim 12, wherein determining the height differential comprises determining the slope of the stack.

16. The method of claim 3, wherein the first and second sensors comprise one or more laser scanners.

17. The method of claim 12, wherein determining a height differential between a lead edge side of the stack and a trail edge side of the stack comprises obtaining a first measurement at generally near a lead edge side of the stack and obtaining a second measurement at generally near a trail edge side of the stack.

18. The method of claim 17, wherein obtaining a second measurement at generally a trail edge side of the stack comprises providing a sensor operably coupled to the block pusher plate and moveable therewith relative to the stack for determining a distance from the sensor to the trail edge side of the stack.

19. The method of claim 4, wherein the known point on the block pusher plate above a trail edge side of the stack is the position of the second sensor.

* * * * *